United States Patent [19]

Byrne, Jr.

[11] 4,332,062

[45] Jun. 1, 1982

[54] BOWL STRUCTURE

[75] Inventor: Joseph H. Byrne, Jr., Houston, Tex.

[73] Assignee: Bowen Tools, Inc., Houston, Tex.

[21] Appl. No.: 122,420

[22] Filed: Feb. 19, 1980

[51] Int. Cl.[3] ..... F16I 7/00

[52] U.S. Cl. ..... 24/263 DA

[58] Field of Search ..... 24/263 D, 263 DA, 263 DB, 24/263 DC, 263 DH, 263 DN, 263 DD, 263 DQ, 263 DT, 263 R

[56] References Cited

U.S. PATENT DOCUMENTS

| | | | |
|---|---|---|---|
| 1,400,701 | 12/1921 | Vreeland | 24/263 DQ |
| 1,810,106 | 6/1931 | Johansen | 24/263 R |
| 2,071,637 | 2/1937 | Laurent | 24/263 R |
| 2,127,108 | 8/1938 | Driscoll | 24/263 R X |
| 2,153,770 | 4/1939 | Nixon | 24/263 |
| 2,217,072 | 10/1940 | Nixon | 24/263 R X |
| 2,347,922 | 5/1944 | Nelson | 24/263 D |
| 2,527,954 | 10/1950 | Nixon | 24/263 R |
| 3,579,752 | 5/1971 | Brown | 24/263 DQ |

OTHER PUBLICATIONS

Cavins Company Publication, "Spider for Casing-Tubing and Drill Pipe".

Joy Oil Tools Publication.

B. J. Company Publication.

Hydarig 225 Bowl Print.

*Primary Examiner*—Roy D. Frazier

*Assistant Examiner*—Peter A. Aschenbrenner

*Attorney, Agent, or Firm*—Pravel, Gambrell, Hewitt, Kirk & Kimball

[57] ABSTRACT

A well bowl has an opening extending through the bowl, at least a portion of which is formed in the shape of a pyramidal frustum. A plurality of slips are movable along the pyramidal surfaces and together define an inner opening, the slip surfaces which define the inner opening being adapted to engage and hold the outer surface of a length of drill pipe when the slips are moved toward the smaller end of the bowl opening. The slips are disengaged from the drill pipe when they are moved away from the smaller end of the bowl opening and have outer surfaces shaped to engage at least a portion of the surfaces which define the bowl opening when the slips move between their engaging and disengaging positions. The slips are guided along the surfaces which define the bowl for maintaining the slip surfaces which engage the pipe oriented in their pipe engaging positions when they move along the bowl surfaces.

6 Claims, 5 Drawing Figures

10
12
18
24
30
31
32
34
36
38
42
44
46
48
50

10a
10b
10d
14
16
24
26
31
32
38
40
42
44
46
50

BOWL STRUCTURE

BACKGROUND OF THE INVENTION

This invention relates to well spiders which are used to engage and hold drill pipe for preventing the weight of the pipe from exerting a downward force into the well and, more particularly, to an improved bowl and slip configuration which increases the life expectancy of the bowl and portions of the slips which grip the pipe and eliminates unnecessary scarring of the pipe.

Spiders are important in well drilling operations because they hold the drill pipe so that the weight of the pipe does not exert a downward force into the well. Although in some cases an inverted spider has been used for holding the pipe against upward movement, the following discussion focuses on the type of spider which holds pipe against downward movement and the terms "upper," "lower," etc. are used in that context although the invention can be applied to and covers inverted spiders.

An essential feature of a spider is a bowl with an opening extending through it in the shape of a conical or pyramidal frustum with the smaller dimension of the opening normally at the lower end of the bowl. Elements known as slips are designed to move between one position where they engage the surfaces which define the bowl opening and grip the drill pipe and another position where they are disengaged from the pipe. When the slips engage the surfaces which define the bowl opening, the downward force exerted by the drill pipe causes a reactive lateral force through the slips in the direction of the pipe for providing a tighter grip on the pipe.

Prior art bowls have typically been formed with an opening having a conical frustum shape and cooperating slips, usually four of them, are moved into and out of the opening. It has been found, however, that although the slips can be formed with outer surfaces which conform to the shape of the conical opening, when the slips engage the bowl and the drill pipe exerts a downward force on the slips, each slip deforms and tends to flatten between its ends which causes excessive wear on the contacting surfaces.

In addition, in one commercially available spider unit the slips are moved into and out of engagement with the drill pipe by pivoting the slips relative to the bowl opening so that whenever the slips are moved into engagement with the pipe the lower ends of the gripping surfaces first engage the pipe and the entire gripping surfaces do not engage the pipe until the slips are in their lowermost positions in the bowl. This results in unnecessary scarring on the pipe and premature wearing on the lower ends of the gripping surfaces.

In another commercially available device slip sections are suspended from a single linkage arm and after the slips are brought into contact with the pipe they are moved around the pipe which also causes unnecessary wear on the pipe as well as on the gripping surfaces of the slips.

In a similar device each separate slip has its own linkage actuated by a ring connected to an air cylinder. The slips are raised and lowered into the bowl through an arc-shaped path so that the lower ends of the slips engage the pipe before it is engaged by the remaining portions of the gripping surfaces. In addition to the drawbacks discussed above, since there is no coordination among the slips two of them normally engage the pipe first and carry the entire load, causing undue stress in the portions of the bowl which support those slips.

In another commercially available device, slips have dovetail-shaped slots on their back surfaces and slide up and down on dovetailed-shaped posts. The posts are designed to replace the bowl and do not have sufficient contact area in order to properly support the weight of the pipe, resulting in high stresses and a short useful life for the apparatus. Such a device is shown in U.S. Pat. No. 2,071,637.

In another development, as shown in U.S. Pat. No. 2,527,954, a well spider has been formed with a bowl opening in the shape of an inverted pyramidal frustum with four sides. Two slip sections are pivoted together and are raised and lowered relative to the bowl in such a way that the gripping surfaces of the slips do not necessarily engage the pipe uniformly across the surfaces during all phases of the operation. Further, the bowl is formed in two sections which are hinged together and require a relief surface to be machined into the intersecting pyramid surfaces in each section. This additional machining step significantly adds to the difficulty of fabricating the bowl and increases the production costs.

SUMMARY OF THE INVENTION

An improved bowl and slip configuration for a well spider has been developed in accordance with the invention. The bowl is formed of a plurality of bowl sections which are connected together. An opening extending through the bowl has the shape of an inverted pyramidal frustum with four sides which has been found to offer significant advantages over conical-shaped bowls. A greater contact area between the slip body and bowl surface is provided with the pyramid shape for the same vertical dimension so that the overall height of the spider can be shorter with the same effective contact area between the slip body and bowl. Further, excessive wear is eliminated because the stress distribution across the flat contact surfaces of the bowl and slip is more uniform than across curved surfaces.

The bowl is preferably formed in four sections with one of the sides of the pyramid in each section. All the sections are identical in shape and can be fabricated at a lower cost than prior art devices since a flat contact surface can easily be machined into each section. With a single flat surface on each section, it is also easier to heat treat, carburize or hard coat the surfaces than where curved or multi-sided surfaces are used. Also by forming the bowl of four different segments the relief machining required in, for example, U.S. Pat. No. 2,527,954 is eliminated. Further, field repair of the flat surfaces by building them up with hard surfacing and grinding back to tolerance is much easier than with curved surfaces.

A plurality of slips is provided, preferably one for each bowl section. Each slip has an outer surface shaped to engage substantially the entire surface defining the bowl opening of the cooperating section of the bowl when the slips are in their lowermost position. A double-sided dovetail-shaped guide key which engages cooperating slots in the bowl surfaces and slips operates to guide the slips along the flat bowl surfaces. The slips also defined an inner cylinder opening for accommodating a length of pipe and include replacable inserts or liners which have roughened gripping surfaces oriented parallel to the drill pipe so that when all of the slips are in their lowermost position they will grip the outer surface of the pipe and prevent the pipe from exerting a downward force into the well.

A connecting ring engages an upper slotted arm formed integral with the slips. The ring is selectively raised and lowered by hydraulic pistons for simultaneously raising and lowering the slips by sliding them along the surfaces defining the bowl opening. In this way, the gripping surfaces of the slip liners remain parallel to the pipe when the slips are raised and lowered so that whenever the slips are brought into and out of engagement with the drill pipe the entire gripping surfaces simultaneously and uniformly engage or become disengaged from the drill pipe to prevent unnecessary scarring or gouging of the pipe.

Although dovetail-shaped guides are used between the bowl and slips, no force is exerted on the guides, the downward force being evenly distributed across the surfaces which define the bowl opening. Since the bowl surfaces are designed to withstand force exerted by the pipe, the bowl and slips have a longer useful life.

BRIEF DESCRIPTION OF THE DRAWINGS

A better understanding of the invention can be obtained when the detailed description of a preferred embodiment set forth below is considered in conjunction with the accompanying drawings, in which.

DETAILED DESCRIPTION OF A PREFERRED EMBODIMENT

Figure 1:
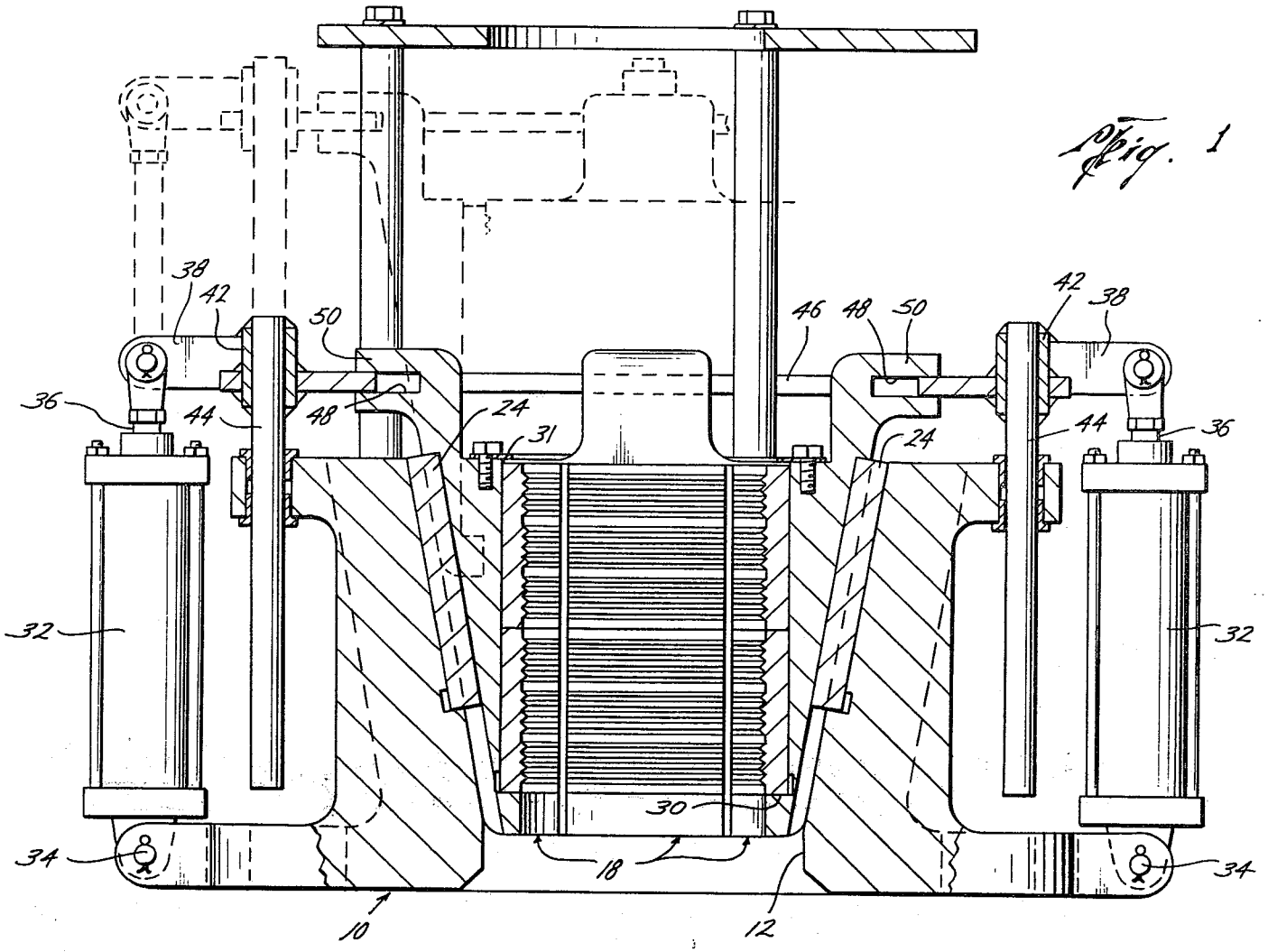
FIG. 1 is a front sectional view of the overall spider.
Figure 2:
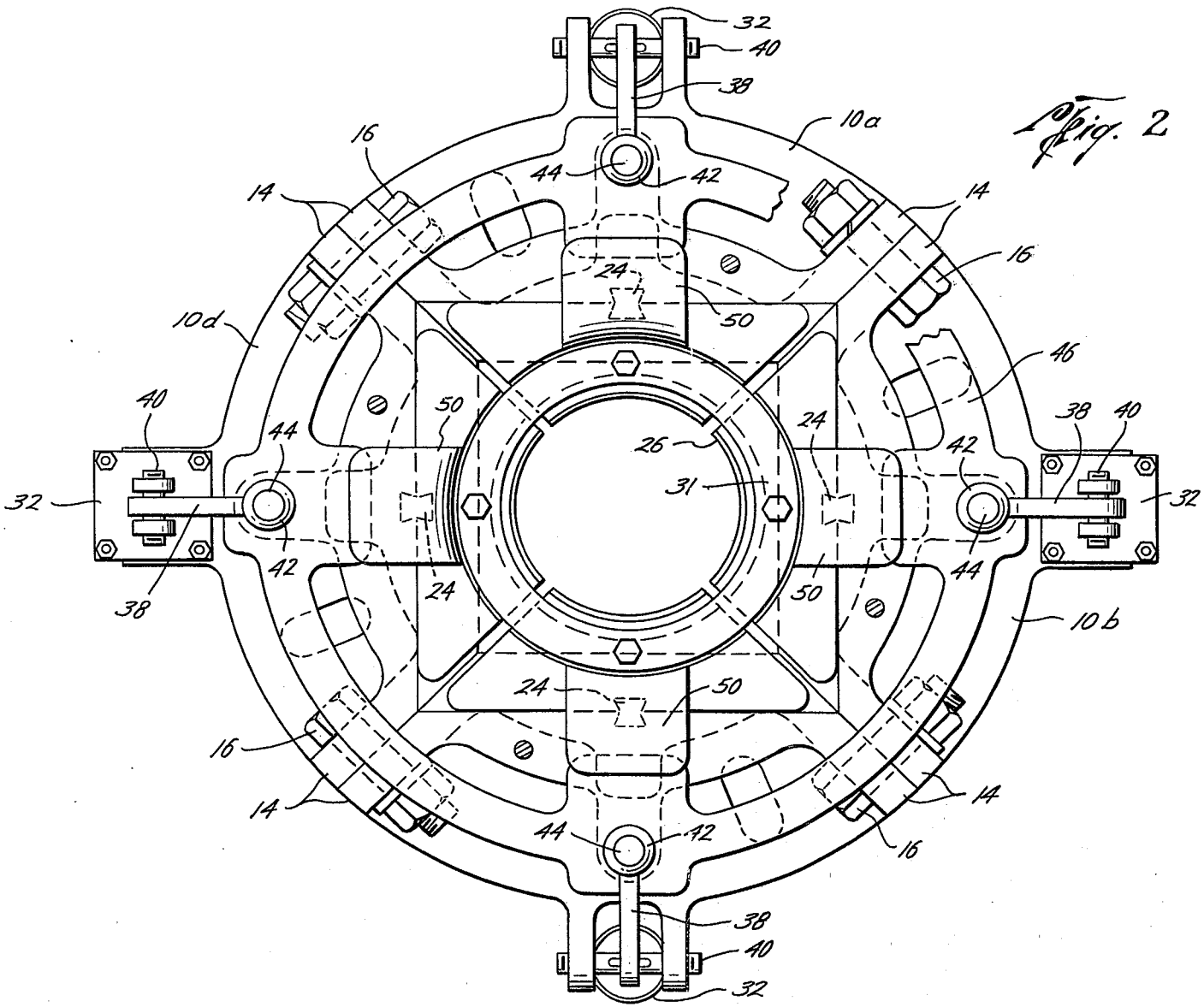
FIG. 2 is a top plan view of the apparatus shown in FIG. 1.

Referring to FIGS. 1 and 2, reference numeral 10 generally refers to a bowl portion of a well spider apparatus. The bowl 10 includes an opening 12 which, as shown best in FIGS. 1 and 3, extends through the bowl 10 and is defined along at least a substantial portion of its length by surfaces which are formed in a pyramidal frustum with four sides. The bowl 10 is formed of four sections 10*a*, 10*b*, 10*c* and 10*d* which can be joined together through appropriate lugs 14 and bolts 16, as shown best in FIGS. 1 and 4. By forming the bowl 10 in separate sections as shown, flat surfaces 17 which define the pyramid-shaped portion of the opening 12 can easily be machined at the proper angle which significantly reduces scrap compared with a tapered cone shape. In addition, the flat surfaces 17 can be heat treated, carburized or hard coated to a greater hardness since the tapered surfaces can easily be brought within specified tolerances by a grinder or the like. Should the surfaces become stored or inordinately worn, they can be required in the field by building them back up with surfacing equipment and then grinding back to tolerance, an operation which is not possible with a conical-shaped bowl or one having a pyramidal shape but formed with more than one surface on each section.

Figure 3:
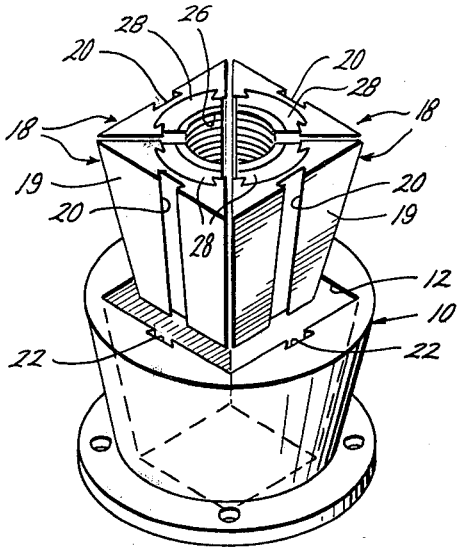
FIG. 3 is a partially exploded perspective view showing, in particular, the positions of the slips relative to each other when they are in their lowermost positions in the bowl, although the slips are shown out of the bowl.
Figure 4:
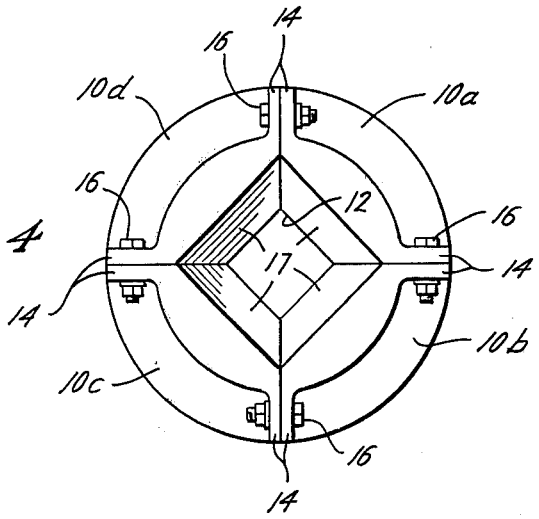
FIG. 4 is a top plan view of the bowl.
Figure 5:
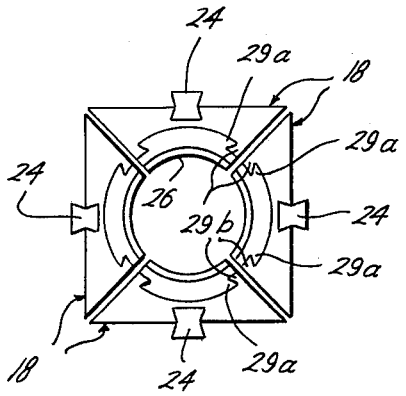
FIG. 5 is a top plan view of the slips and liner inserts.

As shown best in FIGS. 3 and 5, a plurality of slips 18 are designed to fit in the opening 12 as described in detail below. Four identically-shaped slips 18 are provided, each of which is formed with an outer surface 19 shaped to engage substantially the entire flat surface 17 of its respective bowl section when the slips 18 are in the lower positions shown by the solid lines in FIG. 1. A dovetailed-shaped groove 20 is formed in each of the outer surfaces 19 and a similarly-shaped groove 22 is formed in the upper portion of each flat surface 17. As shown best in FIGS. 1 and 5, a double-sided, dovetail-shaped, guide key 24 is inserted in each pair of cooperating grooves 20 and 22 for guiding the slips 18 along the surfaces 13 as described below. It should be noted that the keys 24 operate only as guides and have little, if any, force exerted on them.

The inner surfaces of the slips 18 together form a cylindrical opening 26 through which a length of drill pipe (not shown) or the like can project. The opening 26 is defined by appropriately roughened or patterned gripping surfaces of liner inserts 28 which are removably mounted in each of the slips 18. Interconnecting dovetail-shaped sections 29*a* and 29*b*, a ledge 30 formed in the lower inner portion of each of the slips 18 (see FIG. 1) and an upper retaining ring 31 (see FIGS. 1 and 2) operate to hold the inserts 28 in place. The inner surfaces of the inserts 28 are formed to engage and grip the drill pipe and hold it against downward movement. Configurations of such surfaces are known in the art and will not be described in detail.

As shown best by the solid and broken lines in FIG. 1, the slips 18 can be moved between a lowermost position shown by the solid lines where the gripping surfaces of the liners 28 engage the drill pipe and an upper position shown by the broken lines where the slips are moved upwardly out of engagement with the drill pipe. As the slips 18 move up and down, the keys 24 accurately guide them along predetermined paths along the surfaces 17. As mentioned above, it is important that the entire gripping surfaces of all the inserts 28 simultaneously and uniformly engage the outer surface of the drill pipe to minimize wear on the gripping surfaces and prevent unnecessary scratching or scarring on the outer surface of the drill pipe. By keeping the outer surfaces 19 of the slips 18 in continuous contact with the flat surfaces 17 which define the opening 12, this optimum positioning of the gripping surfaces is achieved.

The slips 18 are moved up and down by a plurality of hydraulic cylinders 32 connected to the bowl 10 through pins 34. The cylinders 32 include movable pistons (not shown) which are connected to the slips 18 through rods 36 and linkages which include arms 38 which are connected to the rods 36 through pins 40. The linkages also include guide sleeves 42 which engage guide posts 44 rigidly connected to the bowl 10 for guiding the linkage up and down along predetermined paths. The sleeves 42 are connected to a lift ring 46 which extends around the bowl and engages the slips 10 through slots 48 located in arms 50 which are formed integral with slips 18. When the hydraulic cylinders operate to move the lift ring 46 up and down, and consequently the slips 18, through the rods 36, arms 38 and sleeves 42, the ring 46 moves in and out of the slots 48 for accommodating the relative in and out movement of the slips 18 as they slide along the sloping surfaces 17. These relative positions are shown in FIG. 1 where the solid lines show the lift ring 46 to be near the outer end of the slots 48 when the slips 18 are in their lower position in the bowl 10, whereas the broken lines show the lift ring 46 inserted a greater distance into the slots 48 when the slips 18 have moved upwardly and outwardly away from the pipe. In this way, when the slips 18 move up and down by sliding along the surfaces 17 which define the bowl opening 12, the gripping surfaces of the inserts 28 remain parallel to and equidistant from the drill pipe so that engagement with and disengagement from the pipe is accomplished uniformly and simultaneously.

When the slips 18 are in the lowermost position shown by the solid lines in FIG. 1, the gripping surfaces of the inserts 28 engage the pipe. Downward force caused by the weight of drill pipe is exerted outwardly through the slips 18 resulting in a reactive lateral force exerted inwardly by the flat surfaces 17 which define the bowl opening 12. These lateral forces push the slips 18 toward the pipe and results in a tighter grip. Since the contact surfaces between the bowl 10 and the slips 18 are flat, undue distortion normally caused in rounded shapes during heavy loading is eliminated which effectively increases the life of the unit. As mentioned above, use of the flat surfaces provides more efficient and economical fabrication techniques and allows field repairs to be performed. Since the contact area between the slips 18 and the flat surfaces 17 are greater per given height than comparable curved surfaces, the spider can be built with a shorter vertical dimension and still have the same effective contact area.

Use of the lift ring 46 and the slots 48 in conjunction with the guide keys for moving the slips 18 in and out of the bowl provide accurate movement of the slips relative to the bowl and insure uniform and simultaneous engagement between all the gripping surfaces and the pipe. This interaction prevents undue scarring of the outer pipe surface and eliminates excessive wear of the inserts.

The foregoing disclosure and description of the invention are illustrative and explanatory thereof, and various changes in the size, shape and materials as well as in the details of the illustrated construction may be made without departing from the spirit of the invention and all such changes and contemplated as coming within the scope of the appended claims.

I claim:

1. Improved well bowl, comprising:

(a) a well bowl with an opening extending through the bowl, at least a portion of which is formed in the shape of a pyramidal frustum, the bowl being formed in a plurality of sections, each section including no more than one side of the pyramid-shaped opening, and means for connecting the sections together, (b) a plurality of slips movable along the pyramidal surfaces and together defining an inner opening, the slip surfaces which define the inner opening being adapted to engage and hold the outer surface of a length of drill pipe when the slips are moved toward the smaller end of the bowl opening and to be disengaged from the drill pipe when the slips are moved away from the smaller end of the bowl opening, the slips further having outer surfaces shaped to engage at least a portion of the surfaces which define the bowl opening when the slips move between their engaging and disengaging positions, (c) guide means for guiding the slips along the surfaces which define the bowl and maintaining the slip surfaces which engage the pipe oriented in their pipe engaging positions when they move along the bowl surfaces, and (d) means for simultaneously moving the slips between their engaging and disengaging positions.

2. The improvement of claim 1, wherein the bowl opening has four sides.

3. The improvement of claim 1, wherein the number of slips correspond to the number of bowl sections.

4. The improvement of claim 1, wherein the moving means includes an arm projecting upwardly and outwardly from each slip, a horizontal slot in each arm, a ring engaging all the slots and hydraulic means for moving the ring for moving the slips between the engaging and disengaging positions, the ring moving relative to the arms and in the slots as the slips respectively move toward and away from each other.

5. The improvement of claim 1, wherein the guide means includes a pair of cooperating dovetail-shaped grooves in adjacent surfaces of each slip and the bowl, and a guide key having a double dovetail-shape in each pair of grooves.

6. The improvement of claim 1, wherein each slip includes a removable liner insert connected to the remainder of the slip through cooperating grooves, the liner inserts forming the portion of the slips which engage the drill pipe, and means for holding the liner inserts in place in their respective slips.

* * * * *